US007902912B2

(12) United States Patent
Marinca

(10) Patent No.: US 7,902,912 B2
(45) Date of Patent: Mar. 8, 2011

(54) BIAS CURRENT GENERATOR

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 12/054,909

(22) Filed: Mar. 25, 2008

(65) Prior Publication Data

US 2009/0243711 A1 Oct. 1, 2009

(51) Int. Cl.
*G05F 1/10* (2006.01)
*G05F 3/02* (2006.01)

(52) U.S. Cl. ..... 327/539

(58) Field of Classification Search ..... 327/539, 327/512–513; 323/313, 315
See application file for complete search history.

(56) References Cited

U.S. PATENT DOCUMENTS

| | | | |
|---|---|---|---|
| 4,399,398 | A | 8/1983 | Wittlinger |
| 4,475,103 | A | 10/1984 | Brokaw et al. |
| 4,603,291 | A | 7/1986 | Nelson |
| 4,714,872 | A | 12/1987 | Traa |
| 4,800,339 | A | 1/1989 | Tanimoto et al. |
| 4,808,908 | A | 2/1989 | Lewis et al. |
| 4,939,442 | A | 7/1990 | Carvajal et al. |
| 5,053,640 | A | 10/1991 | Yum |
| 5,119,015 | A | 6/1992 | Watanabe |
| 5,229,711 | A | 7/1993 | Inoue |
| 5,325,045 | A | 6/1994 | Sundby |
| 5,352,973 | A | 10/1994 | Audy |
| 5,371,032 | A | 12/1994 | Nishihara |
| 5,424,628 | A | 6/1995 | Nguyen |
| 5,512,817 | A | 4/1996 | Nagaraj |
| 5,563,504 | A | 10/1996 | Gilbert et al. |
| 5,646,518 | A | 7/1997 | Lakshmikumar et al. |
| 5,821,807 | A | 10/1998 | Brooks |
| 5,828,329 | A | 10/1998 | Burns |
| 5,933,045 | A | 8/1999 | Audy et al. |
| 5,952,873 | A | 9/1999 | Rincon-Mora |
| 5,982,201 | A | 11/1999 | Brokaw et al. |
| 6,002,293 | A | 12/1999 | Brokaw |

(Continued)

FOREIGN PATENT DOCUMENTS

EP 0352 044 1/1990

(Continued)

OTHER PUBLICATIONS

PCT/EP2008/067403, International Search Report and Written Opinion, Apr. 27, 2009.

(Continued)

*Primary Examiner* — Quan Tra
(74) *Attorney, Agent, or Firm* — Knobbe, Martens, Olson and Bear LLP

(57) ABSTRACT

A bias current generator for generating bias current is described. The generator comprises an amplifier having an inverting input, a non-inverting input and an output. A first bipolar transistor is associated with one of the inverting and non-inverting inputs of the amplifier. A load MOS device is associated with the other one of the inverting and non-inverting inputs of the amplifier. The load MOS device is driven by the amplifier to operate in the triode region with a corresponding drain-source resistance $r_{on}$. The first bipolar transistor and the load MOS device are arranged such that a voltage derived from the first bipolar transistor is developed across the drain-source resistance $r_{on}$ of the load MOS device thereby generating a bias current.

8 Claims, 7 Drawing Sheets

U.S. PATENT DOCUMENTS

| | | | | |
|---|---|---|---|---|
| 6,075,354 | A | 6/2000 | Smith et al. | |
| 6,157,245 | A | 12/2000 | Rincon-Mora | |
| 6,188,270 | B1 * | 2/2001 | Boerstler | 327/543 |
| 6,218,822 | B1 | 4/2001 | MacQuigg | |
| 6,225,796 | B1 | 5/2001 | Nguyen | |
| 6,255,807 | B1 | 7/2001 | Doorenbos et al. | |
| 6,329,804 | B1 | 12/2001 | Mercer | |
| 6,329,868 | B1 | 12/2001 | Furman | |
| 6,356,161 | B1 | 3/2002 | Nolan et al. | |
| 6,362,612 | B1 | 3/2002 | Harris | |
| 6,373,330 | B1 | 4/2002 | Holloway | |
| 6,400,212 | B1 * | 6/2002 | Sakurai | 327/539 |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,549,072 | B1 | 4/2003 | Vernon | |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,801,095 | B2 | 10/2004 | Renninger, II | |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,906,581 | B2 * | 6/2005 | Kang et al. | 327/539 |
| 6,919,753 | B2 | 7/2005 | Wang et al. | |
| 6,930,538 | B2 | 8/2005 | Chatal | |
| 6,958,643 | B2 | 10/2005 | Rosenthal | |
| 6,987,416 | B2 | 1/2006 | Ker et al. | |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,078,958 | B2 * | 7/2006 | Gower et al. | 327/539 |
| 7,088,085 | B2 | 8/2006 | Marinca | |
| 7,091,761 | B2 | 8/2006 | Stark et al. | |
| 7,112,948 | B2 | 9/2006 | Daly et al. | |
| 7,170,336 | B2 | 1/2007 | Hsu | |
| 7,173,407 | B2 | 2/2007 | Marinca | |
| 7,193,454 | B1 | 3/2007 | Marinca | |
| 7,199,646 | B1 | 4/2007 | Zupcau et al. | |
| 7,211,993 | B2 | 5/2007 | Marinca | |
| 7,224,210 | B2 | 5/2007 | Garlapati et al. | |
| 7,236,047 | B2 | 6/2007 | Tachibana et al. | |
| 7,248,098 | B1 | 7/2007 | Teo | |
| 7,260,377 | B2 | 8/2007 | Burns et al. | |
| 7,301,321 | B1 | 11/2007 | Uang et al. | |
| 7,372,244 | B2 | 5/2008 | Marinca | |
| 7,411,380 | B2 | 8/2008 | Chang et al. | |
| 7,472,030 | B2 | 12/2008 | Scheuerlein | |
| 7,482,798 | B2 | 1/2009 | Han | |
| 7,543,253 | B2 | 6/2009 | Marinca | |
| 7,576,598 | B2 | 8/2009 | Marinca | |
| 7,598,799 | B2 | 10/2009 | Marinca | |
| 7,605,578 | B2 | 10/2009 | Marinca | |
| 7,612,606 | B2 | 11/2009 | Marinca | |
| 7,714,563 | B2 | 5/2010 | Marinca | |
| 7,750,728 | B2 | 7/2010 | Marinca | |
| 2003/0234638 | A1 | 12/2003 | Eshraghi et al. | |
| 2004/0108887 | A1 | 6/2004 | Marsh et al. | |
| 2004/0124822 | A1 | 7/2004 | Marinca | |
| 2004/0124825 | A1 | 7/2004 | Marinca | |
| 2005/0001605 | A1 | 1/2005 | Marinca | |
| 2005/0073290 | A1 | 4/2005 | Marinca et al. | |
| 2005/0134365 | A1 | 6/2005 | Kimura | |
| 2005/0151528 | A1 | 7/2005 | Marinca | |
| 2005/0194957 | A1 | 9/2005 | Brokaw | |
| 2005/0237045 | A1 | 10/2005 | Lee et al. | |
| 2006/0001413 | A1 | 1/2006 | Marinca | |
| 2006/0017457 | A1 | 1/2006 | Pan et al. | |
| 2006/0038608 | A1 | 2/2006 | Ozawa | |
| 2007/0170906 | A1 | 7/2007 | Marinca | |
| 2007/0176591 | A1 | 8/2007 | Kimura | |
| 2008/0018319 | A1 | 1/2008 | Chang et al. | |
| 2008/0074172 | A1 | 3/2008 | Marinca | |
| 2008/0094130 | A1 * | 4/2008 | Uang et al. | 327/539 |
| 2008/0224759 | A1 | 9/2008 | Marinca | |
| 2008/0265860 | A1 | 10/2008 | Dempsey et al. | |
| 2009/0027030 | A1 | 1/2009 | Marinca | |
| 2009/0027031 | A1 | 1/2009 | Marinca | |
| 2009/0160537 | A1 | 6/2009 | Marinca | |
| 2009/0160538 | A1 | 6/2009 | Marinca | |
| 2009/0243708 | A1 | 10/2009 | Marinca | |
| 2009/0243711 | A1 | 10/2009 | Marinca | |
| 2009/0243713 | A1 | 10/2009 | Marinca | |
| 2010/0001711 | A1 | 1/2010 | Marinca | |
| 2010/0127763 | A1 | 5/2010 | Marinca | |
| 2010/0244808 | A1 | 9/2010 | Marinca | |

FOREIGN PATENT DOCUMENTS

| | | |
|---|---|---|
| EP | 0510530 | 10/1992 |
| EP | 1359490 A2 | 11/2003 |
| EP | 1359490 A3 | 11/2003 |
| JP | 4-167010 | 6/1992 |
| KR | 0115143 | 12/2007 |
| WO | WO 2004/007719 | 2/2004 |

OTHER PUBLICATIONS

Pease, R.A., "The design of band-gap reference circuits: trials and tribulations", IEEE 1990 Bipolar circuits and Technology Meeting 9.3, Sep. 17, 1990, pp. 214-218.

PCT/EP2008/067402 International Search Report, Mar. 20, 2009.

PCT/EP2008/058685 International Search Report and written opinion, Oct. 1, 2008.

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press—Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Banba et al, "A CMOS bandgap reference circuit with Sub-1-V operation", IEEE JSSC vol. 34, No. 5, May 1999, pp. 670-674.

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

Jianping, Zeng, et al, "CMOS Digital Integrated temperature Sensor", IEEE, Aug. 2005, pp. 310-313.

International Preliminary Report on Patentability and Written Opinion for PCT/EP2009/053220 mailed Oct. 7, 2010.

* cited by examiner

BIAS CURRENT GENERATOR

FIELD OF INVENTION

The present invention relates to a bias current generator. The invention more particularly relates to a bias current generator which provides bias current without requiring a resistor.

BACKGROUND OF INVENTION

Bias current generator circuits are well known in the art. Such circuits supply current for different sub-circuits of an integrated circuit.

An example of a prior art proportional to absolute temperature (PTAT) bias current generator 100 implemented using bandgap techniques is illustrated in FIG. 1*a*. The bias current generator 100 includes a first bipolar transistor Q1 operating at a first collector current density and a second bipolar transistor Q2 operating at a second collector current density which is less than that of the first collector current density. The emitter of the first bipolar transistor Q1 is coupled to the inverting input of an operational amplifier A and the emitter of the second bipolar transistor Q2 is coupled via a resistor $r_1$ to the non-inverting input of the amplifier A. The output of the amplifier A drives a current mirror arrangement comprising two PMOS transistors of similar aspect ratios, namely, MP1 and MP2 which are biased so that their gate-source voltage Vgs are the same. MP1 and MP2 force equal currents to the emitters of the two bipolar transistors, Q1 and Q2. The collector current density difference between Q1 and Q2 may be established by having the emitter area of the second bipolar transistor Q2 larger than the emitter area of the first bipolar transistor Q1. Alternatively multiple transistors may be provided in each leg, with the sum of the collector currents of each of the transistors in a first leg being greater than that in a second leg. As a consequence of the differences in collector current densities between the bipolar transistors Q1 and Q2 a base-emitter voltage difference ($\Delta V_{be}$) is developed across the resistor $r_1$.

$$\Delta V_{be} = \frac{kT}{q}\ln(n) \tag{1}$$

Where:

k is the Boltzmann constant, q is the charge on the electron,

T is the operating temperature in Kelvin, n is the collector current density ratio of the two bipolar transistors.

This base emitter voltage difference ($\Delta V_{be}$) is inherently PTAT. Assuming that the amplifier A is an ideal amplifier, the emitter currents of Q1 and Q2 are given by equation 2.

$$I(Q1, e) = I(Q2, e) = \frac{\Delta V_{be}}{r1} \tag{2}$$

The bias current generated may then be used to bias the sub-circuits of an integrated circuit by typically mirroring the current which flows through $r_1$.

$$Ibias = \frac{\Delta V_{be}}{r1} \tag{3}$$

Referring now to FIG. 1*b*, another prior art current generator, in this case, a complimentary to absolute temperature (CTAT) current generator 110 is illustrated. The bias current generator 110 is substantially similar to the bias current generator 100, and like components are identified by the same reference labels. The main difference between the bias current generator 100 and the current generator 110 is that a single bipolar transistor is coupled to the inputs of the amplifier A. The amplifier A forces the voltages at the non-inverting and inverting inputs of the amplifier A to be the same. The voltage at the non-inverting input is equal the base emitter voltage of Q1. Thus, the voltage at the inverting input is also equal to the base emitter voltage of Q1, which is inherently CTAT. Therefore, a CTAT voltage is developed across $r_1$:

$$Ibias = \frac{V_{be}}{r1} \tag{4}$$

The temperature coefficients (TC) of the PTAT and CTAT bias currents according to FIGS. 1*a* and 1*b* are influenced by the temperature dependence of resistors. Thus, the bias current is dependent on the value of the resistor r1. It will be appreciated by those skilled in the art that the resistance of resistors may vary from lot to lot of the order of +/−20%. As a consequence, the value of the bias current generated will also vary. A further disadvantage of the prior art current bias generators 100 and 110 is they occupy a large silicon area in an integrated chip. The resistor $r_1$ is one of the primary reasons why the current bias generators 100, 110 occupy a large silicon area. A circuit which occupies a large silicon area is undesirable for low current applications.

Another drawback of resistor based PTAT or CTAT current generators is related to the trimming methods. In order to reduce output current variation due to process variation different methods are used such that the resistor value of $r_1$ is trimmed for the desired output current. Laser trimming methods are used such that a small part of a resistor $r_1$ is "polished" until the desired output current is achieved. Laser trimming is also used to blow a short metal link across a resistor, part of $r_1$, such that the total resistance increases and the bias current decreases. The trimming part of the circuits adopted for laser trimming usually requires large die area. MOS transistors configured as switches are typically coupled in series or parallel with the resistor $r_1$ such that the value of $r_1$ can be digitally controlled. MOS transistors used as switches add errors and nonlinearity on the resulting bias current generated due to the finite value of their drain-source resistance and corresponding nonlinearity.

There is therefore a need to provide a bias current generator which provides a bias current without incorporating a resistor.

SUMMARY OF INVENTION

These and other problems are addressed by providing a bias current generator incorporating a MOS device operating the triode region with a corresponding drain-source resistance $r_{on}$ which behaves like a resistor.

These and other features will be better understood with reference to the followings Figures which are provided to assist in an understanding of the teaching of the invention.

BRIEF DESCRIPTION OF DRAWINGS

The present application will now be described with reference to the accompanying drawings in which.

DETAILED DESCRIPTION

The invention will now be described with reference to some exemplary bias current generators which are provided to assist in an understanding of the teaching of the invention. It will be understood that these circuits are provided to assist in an understanding and are not to be construed as limiting in any fashion. Furthermore, circuit elements or components that are described with reference to any one Figure may be interchanged with those of other Figures or other equivalent circuit elements without departing from the spirit of the present invention.

Figure 1A:
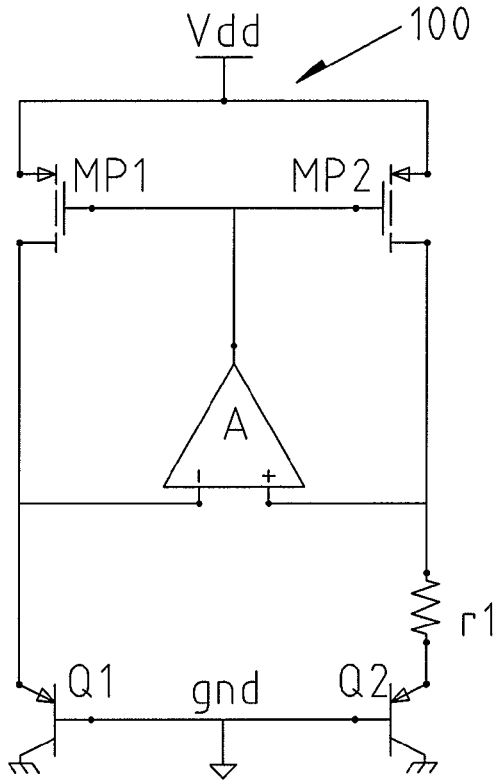
PRIOR ART Fig. 1a
FIG. 1*a* is a schematic circuit diagram of prior art bias current generator.
Figure 1B:
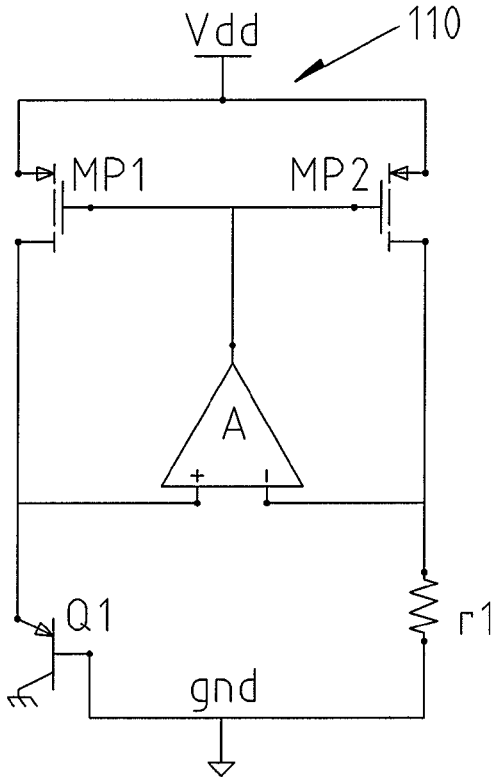
PRIOR ART Fig. 1b
FIG. 1*b* is a schematic circuit diagram of prior art bias current generator.
Figure 2:
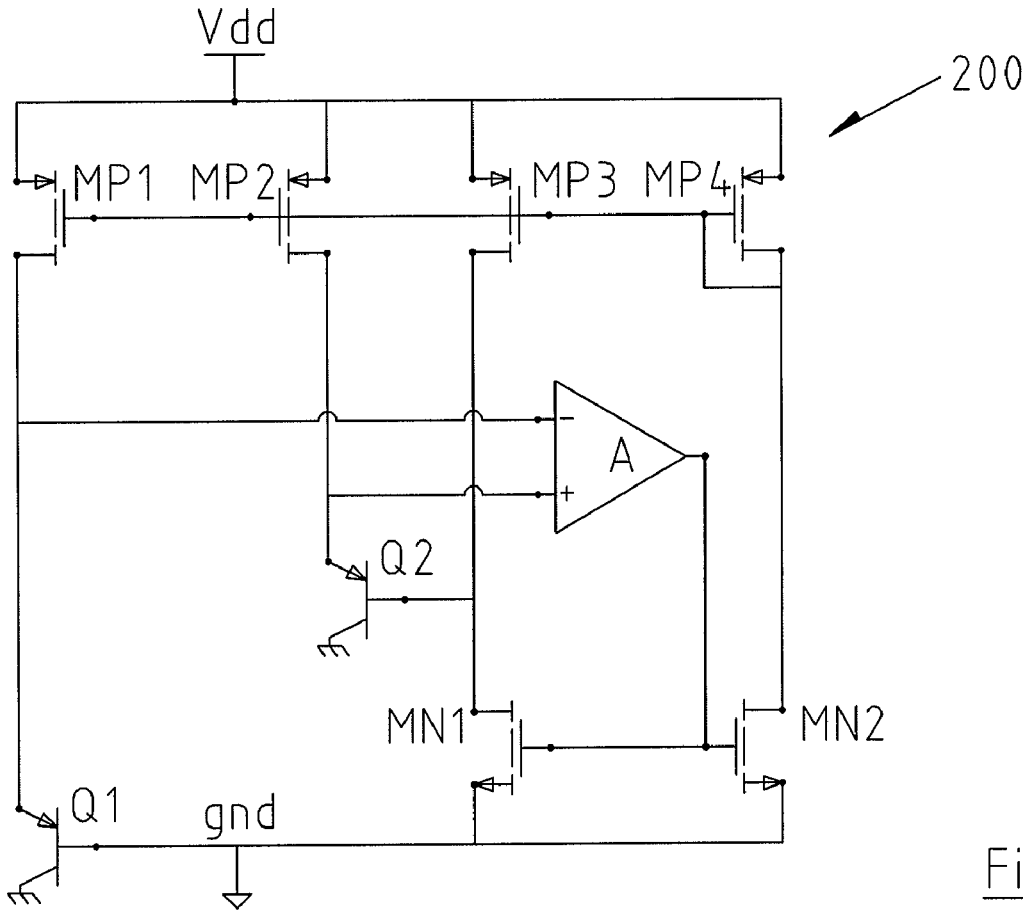
FIG. 2 is a schematic circuit diagram of a circuit provided in accordance with the teaching of the present invention.

Referring to the drawings and initially to FIG. 2 there is illustrated a bias current generator circuit 200 which generates a bias current using a load MOS device as opposed to a resistor in accordance with the teaching of the present invention. The circuit 200 comprises a first PNP bipolar transistor Q1, and a second PNP bipolar transistor Q2 operating at different collector current densities. The first bipolar transistor Q1 operates at a higher collector current density than that of the second bipolar transistor Q2. In this exemplary arrangement Q1 is a unity emitter area bipolar transistor and Q2 consists of a plurality of parallel unity emitter area bipolar transistors. In this way it will be understood that the collector current density difference from Q1 to Q2 is related to the emitter area difference between Q1 and Q2. An example of an alternative way to establish the collector current density difference from Q1 to Q2 is to provide the emitter area of the second bipolar transistor Q2 a constant "n" times larger than the emitter area of the first bipolar transistor Q1. It will be appreciated by those skilled in the art that such differences in collector current density may be achieved in any one of a number of different ways and it is not intended to limit the teaching of the present invention to any one specific arrangement.

The first bipolar transistor Q1 has its emitter coupled to the inverting terminal of an operational amplifier (op-amp) A, and the second bipolar transistor, Q2 has its emitter coupled to the non-inverting terminal of the op-amp A. The collector and base of the first bipolar transistor Q1, and the collector of the second bipolar transistor Q2 are coupled to a ground node gnd. The emitters of the bipolar transistors Q1 and Q2 are biased with current from a current mirror comprising four PMOS transistor MP1, MP2, MP3, and MP4 each of which have their source coupled to a power supply Vdd and their gates coupled together. The aspect ratios of the PMOS transistors MP1, MP2, MP3 and MP4 are similar so that MP1, MP2 and MP3 mirror the drain current of MP4. The drain of the PMOS transistor MP1 is coupled to the emitter of the first bipolar transistor Q1, and the drain of the PMOS transistor MP2 is coupled to the emitter of the second bipolar transistor Q2. It will be appreciated by those skilled in the art that the collector current density difference between Q1 and Q2 can also be achieved by having the aspect ratio (Width/Length (W/L) of the MOS device) of MP1 greater than the aspect ratio (W/L) of MP2 so that the drain current of MP1 is greater than the drain current of MP1.

The output of the op-amp A drives the gates of two NMOS transistors, a load NMOS device MN1 and a biasing NMOS device MN2, which have different aspect ratios. The sources of both MN1 and MN2 are coupled to ground. The drain of MN1 is coupled to the base of the second bipolar transistor Q2 which is also coupled to the drain of the PMOS transistor MP3. The drain of MN2 is coupled to the drain of the PMOS transistor MP4 which is in a diode configuration. In this example, MN1 consists of a plurality "n1" unity stripe NMOS transistor coupled together in parallel, and MN2 consists of a plurality "n2" unity stripe NMOS transistor coupled together in parallel so that MN1 and MN2 have different aspect ratios. Alternatively, and as was mentioned above, the difference in aspect ratios between MN1 and MN2 may be achieved by appropriately varying the "Lengths" and "Widths" of the transistors. It will be appreciated by those skilled in the art that varying the aspect ratios may be achieved in any one of a number of different ways and it is not intended to limit the teaching of the present invention to any one specific arrangement.

In operation, the amplifier A forces its inverting and non-inverting inputs to the same voltage level, via MN2, MP4, MP3, MP2, MP1, such that the base-emitter voltage difference from Q1 to Q2 is reflected across MN1 from drain to source. For n1>n2 MN2 operates in the saturation region and MN1 operates in the triode region. The load NMOS transistor MN1 is driven by the amplifier A so that it operates in the triode region with a corresponding drain-source resistance $r_{on}$. As the drain of the load NMOS transistor MN1 is coupled to the base of the second bipolar transistor Q2 a base-emitter voltage difference ($\Delta V_{be}$) resulting from the collector current density differences between the first and second bipolar transistors Q1, Q2 is developed across the drain-source resistance $r_{on}$ of MN1. The base-emitter voltage difference ($\Delta V_{be}$) from Q1 to Q2 is reflected across $r_{on}$ of MN1 which results in generation of a bias current $I_{bias}$.

$$I_{bias} = I(MP4, d) = \frac{\Delta V_{be}}{r_{on}} \tag{5}$$

Figure 3:
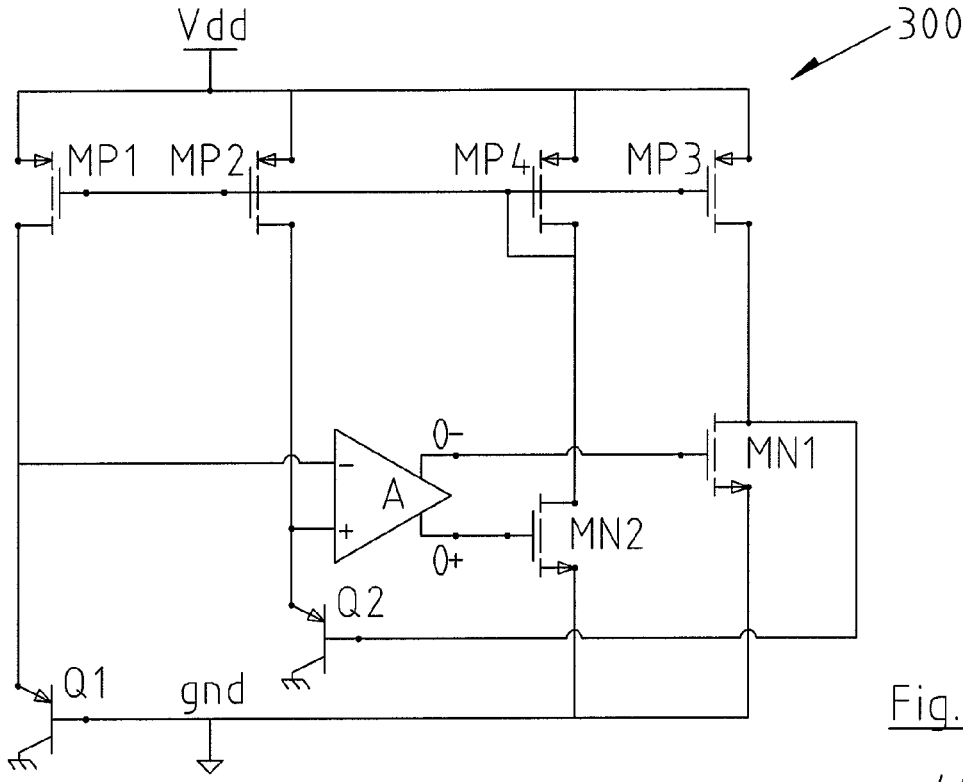
FIG. 3 is a schematic circuit diagram of a circuit provided in accordance with the teaching of the present invention.

Referring now to FIG. 3, there is illustrated another bias current generator 300 which generates a bias current using a load MOS device in accordance with the teaching of the present invention. The bias current generator 300 is substantially similar to the bias current generator 200, and like components are identified by the same reference labels. The main difference is that the amplifier A as well as having differential inputs also has differential outputs, namely, non-inverting output, o+, and inverting output, o−. The non-inverting output of the amplifier A, o+, is coupled to the gate of the biasing NMOS transistor MN2, and the inverting output of the amplifier A, o−, is coupled to the gate of the load NMOS transistor MN1. The load NMOS transistor MN1 is driven by the amplifier A so that it operates in the triode region with a corresponding drain-source resistance $r_{on}$. As the drain of the load NMOS transistor MN1 is coupled to the base of the second bipolar transistor Q2 a base-emitter voltage difference ($\Delta V_{be}$) resulting from the collector current density differences between the first and second bipolar transistors is developed across the drain-source resistance $r_{on}$ of MN1. The biasing NMOS transistor MN2 is driven by the amplifier A to generate feedback currents for biasing the first and second bipolar transistors Q1, and Q2, and the load NMOS transistor MN1 via MP4, MP1, MP2 and MP3. There are two negative feedback loops around the amplifier A. The first negative feedback loop with dominant gain is from the non-inverting output, o+, via MN2, MP4, and MP2 to the non-inverting input. The second negative feedback loop with less gain than the first feedback loop is from the inverting output, o−, via MN1, Q2 to the non-inverting input of the amplifier A. Due to this double negative feedback the amplifier is more stable compared to the amplifier of circuit 200.

Figure 4:
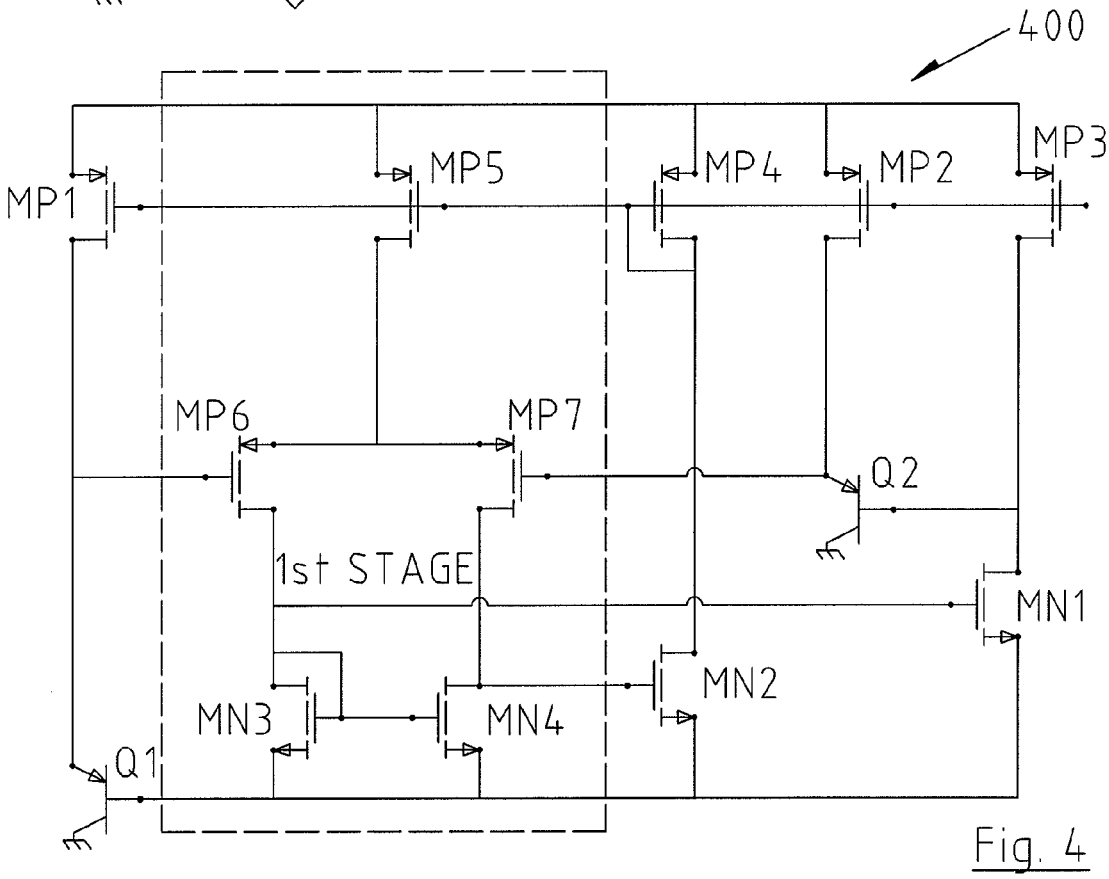
FIG. 4 is a schematic circuit diagram of a circuit provided in accordance with the teaching of the present invention.

Referring now to FIG. 4, there is illustrated another bias current generator 400 which, in accordance with the teaching of the present invention, generates a bias current without using a resistor. The bias current generator 400 is substantially similar to the bias current generator 200, and like components are identified by the same reference labels. The main difference is that the amplifier A is illustrated at transistor level rather than at block level. The components that define the amplifier A are enclosed by the broken lines in FIG. 4. The amplifier A is a single stage amplifier with two input PMOS transistors, MP6 and MP7, two load NMOS transistors, MN3 and MN4 and a self biased PMOS transistor MP5. MN2 and MP4 correspond to a second stage amplifier. The start-up circuit of the amplifier A is omitted for clarity. It will be appreciated that different architectures may be implemented for the first stage of the amplifier, for example, NMOS input pair, folded cascade, etc.

Figure 5:
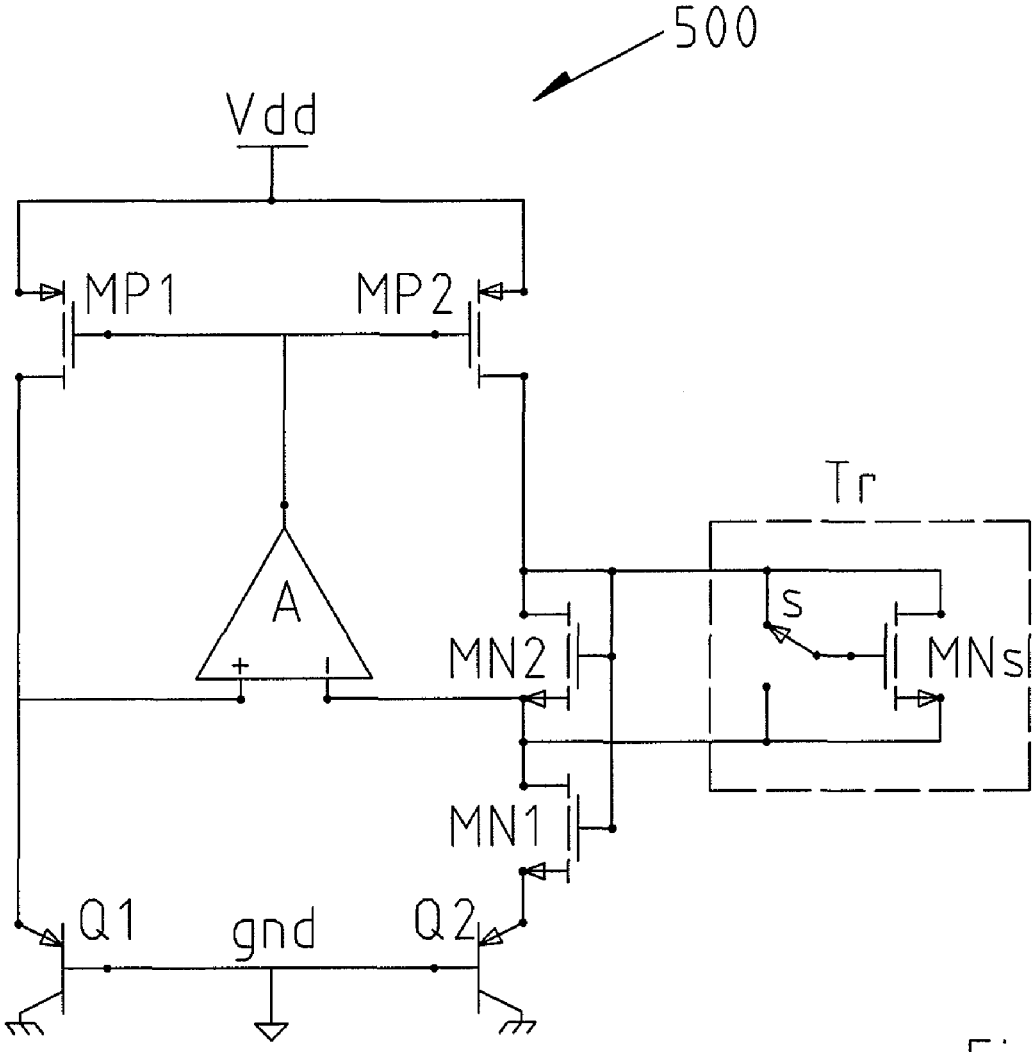
FIG. 5 is a schematic circuit diagram of a circuit provided in accordance with the teaching of the present invention.

Referring now to FIG. 5, there is illustrated another bias current generator 500 which generates a PTAT bias current without using a resistor in accordance with the teaching of the present invention. The bias current generator 500 includes a first PNP bipolar transistor Q1 operating at a first collector current density and a second PNP bipolar transistor Q2 operating at a second collector current density which is less than that of the first collector current density. The emitter of the first bipolar transistor Q1 is coupled to the non-inverting input of an operational amplifier A and the emitter of the second bipolar transistor Q2 is coupled via a load device, namely, NMOS transistor MN1 to the inverting input of the amplifier A. Thus, Q1 is associated with one of the inputs to the amplifier A and Q2 is associated with the other one of the inputs to the amplifier A. The bases and the collectors of both bipolar transistors Q1 and Q2 are coupled to ground. The output of the amplifier A drives a current mirror arrangement comprising two PMOS transistors of similar aspect ratios, namely, MP1 and MP2 which are biased so that their gate-source voltage Vgs are the same so that their drain currents are equal. The sources of the PMOS transistors MP1, MP2 are coupled to Vdd.

A biasing device, in this case, a diode connected NMOS transistor MN2 is connected in a cascoded manner intermediate the NMOS transistor MN1 and the PMOS transistor MP2. The load NMOS transistor MN1 is biased to operate in the triode region such that the NMOS transistor MN1 has a corresponding drain-source resistance $r_{on}$. In this arrangement MN1 operates as a linear resistor. The NMOS transistor MN2 is biased to operate in the saturation region. MN1 and MN2 are biased with the drain current from MP2.

The biasing of MN1 and MN2 is achieved by operably coupling MN1 to MN2 such that MN2 is forced to operate in saturation, and MN1 in the triode region (linear) region. In this embodiment, the gate and drain of MN2 are coupled to the drain of the PMOS transistor MP2, while the source of MN2 is coupled to the inverting input of the amplifier A. The drain of MN1 is also coupled to the inverting input of the amplifier A, and the source of MN1 is coupled to the emitter of the bipolar transistor Q2. The gate of MN1 is tied to the gate and drain of MN2.

The collector current density difference between Q1 and Q2 may be established by having the emitter area of the second bipolar transistor Q2 larger than the emitter area of the first bipolar transistor Q1. Alternatively multiple transistors may be provided in each leg, with the sum of the collector currents of each of the transistors in a first leg being greater than that in a second leg. As a consequence of the differences in collector current densities between the bipolar transistors Q1 and Q2 a base-emitter voltage difference ($\Delta V_{be}$) is developed across the drain-source resistance $r_{on}$ of MN1 resulting in a PTAT bias current:

$$Ibias = \frac{\Delta V_{be}}{r_{on}} \tag{6}$$

The bias current $I_{bias}$ generated may be used to bias subcircuits of an integrated circuit by mirroring the current which flows through MN1.

A trimming circuit Tr is coupled in parallel to the NMOS transistor MN2. This circuit provides for a varying of the gate source voltage of MN2 which in turn varies the gate source voltage of MN1. The resistance $r_{on}$ of MN1 changes as the gate source voltage of MN1 changes which allows the bias current to be tuned to a desired value. In this exemplary arrangement of a suitable trimming circuit, the trimming circuit Tr comprises a plurality of binary weighted NMOS transistors MNs selectively coupled in parallel with the biasing device MN2. For convenience only one NMOS transistor MNs is shown in FIG. 5, but it will be understood that it is not intended to limit the teaching of the present invention to any one specific arrangement. The trimming circuit Tr also comprises a switch S for selectively coupling the gate of transistor MNs to one of the drain and source of transistor MN2. It will be appreciated by those skilled in the art that the drain of transistor MN2 is at a higher voltage than the source of transistor MN2. When the switch S couples the gate of MNs to the drain of MN2 the transistor MNs is switched on resulting in MNs being coupled in parallel with MN2. As a consequence, the aspect ratio of the biasing device increases. This in turn results in the gate source voltage of MN2 being reduced which reduces the gate source voltage of MN1. A reduction in the gate source voltage of MN1 results in the resistance $r_{on}$ of MN1 increasing which in turn causes the bias current $I_{bias}$ to reduce. When the switch S couples the gate of MNs to the source of MN2 the transistor MNs is switched off thus MNs has no effect on the gate source voltage of MN2 and the generated bias current remains unchanged.

Figure 6:
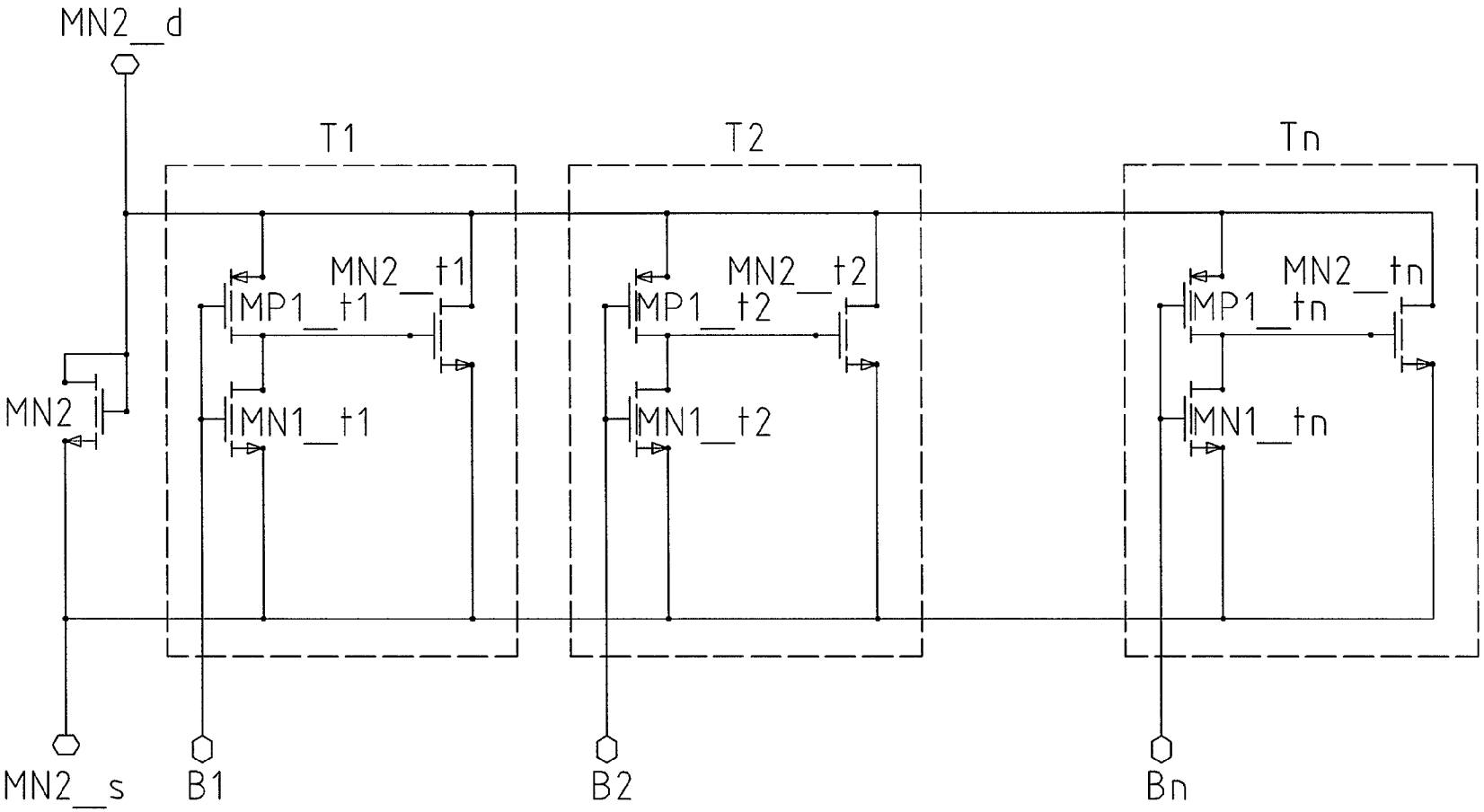
FIG. 6 is a schematic circuit diagram of a detail of the circuit of FIG. 5.

Referring now to FIG. 6 an exemplary implementation of the trimming circuit Tr of FIG. 5 which is used for varying the $r_{on}$ resistance of MN1 is illustrated. The trimming circuit of FIG. 6 comprises a plurality of trimming cells T1 to Tn each comprising a corresponding NMOS transistor MN2_t1 to MN2_tn. The NMOS transistors MN2_t1 to MN2_tn have aspect ratios which are binary weighted. For example, the aspect ratio (W/L) of MN2_t2 of cell T2 is twice that of the aspect ratio (W/L) of MN2_t1 of cell T1. The aspect ratio of the largest transistor MN2_tn is less than the aspect ratio of the biasing transistor MN2. The number/magnitude of the cells is related to the desired level of fine tuning required and the semiconductor process used to fabricate the current generator. In this schematic, only three cells T1 to Tn are shown; however, it will be appreciated, that any desired number of cells may be provided. Typically, the trimming circuit Tr comprises either eight cells, sixteen cells, thirty-two cells, sixty-four cells, etc. For convenience only one trimming cell Tn will be described, however, it will be understood that the other two trimming cells T1 and T2 operate in the same manner as trimming cell Tn. The trimming cell Tn comprises an NMOS transistor MN2_tn and an CMOS inverter. The transistor MN2_tn and the CMOS inverter are coupled between the drain-source nodes MN2_d and MN2_s of MN2. The CMOS inverter comprises a PMOS transistor MP1_tn and an NMOS transistor MN1_tn with their gates coupled together. The CMOS inverter is driven by a logic signal $B_n$ from a digital control block, and the output the CMOS inverter drives the gate of MN1_tn. If the logic signal $B_n$ is '1' the PMOS transistor MP1_tn is turned on and the NMOS transistor MN1_tn is turned off. Thus, when $B_n$ is '1' the gate of MN2_tn is coupled to the drain of MN2 causing MN2_tn to be coupled in parallel with the biasing device MN2. As a consequence, the aspect ratio of the biasing device increases which results in the gate source voltage of MN2 being reduced which in turn reduces the gate source voltage of MN1. A reduction in the gate source voltage of MN1 results in the resistance $r_{on}$ of MN1 increasing which in turn causes the bias current $I_{bias}$ to reduce. If the logic signal $B_n$ is '0' the PMOS transistor MP1_tn is turned off and the NMOS transistor MN1_tn is turned on. Thus, when $B_n$ is '0' the gate of MN2_tn is coupled to the source of MN2 resulting in the generated bias current remaining unchanged as MN2_tn is switched off.

Figure 7:
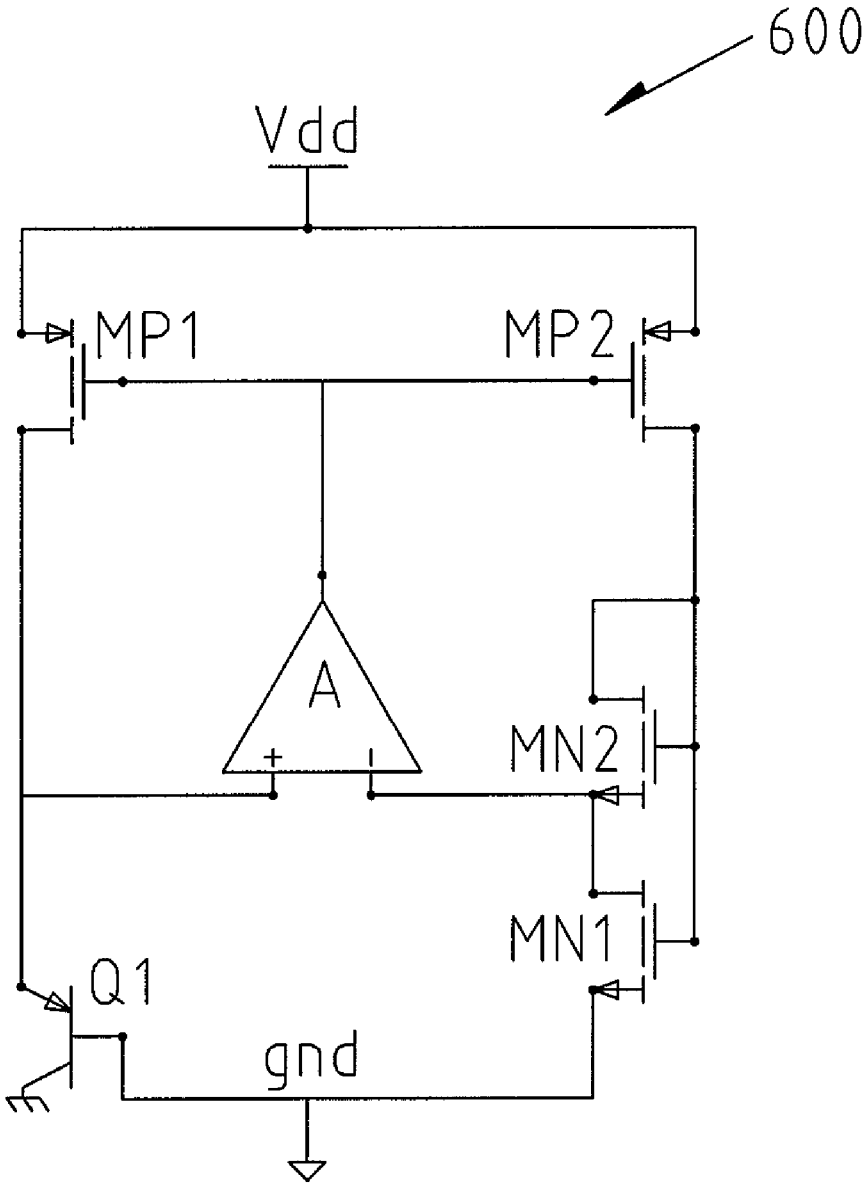
FIG. 7 is a schematic circuit diagram of a circuit provided in accordance with the teaching of the present invention.

Referring now to FIG. 7, there is illustrated another bias current generator 600 which generates a CTAT bias current without using a resistor in accordance with the teaching of the present invention. The bias current generator 600 is substantially similar to the bias current generator 500, and like components are identified by the same reference labels. The load NMOS transistor MN1 operates in the triode region and the biasing device MN2 operates in the saturation region. The main difference between the bias current generator 600 and the current generator 500 is that a single bipolar transistor is coupled to the inputs of the amplifier A. The amplifier A forces the voltages at its non-inverting and inverting input to be the same. The voltage at the non-inverting input is equal the base emitter voltage of Q1. Thus, the voltage at the inverting input is also equal to the base emitter voltage of Q1. Therefore, a CTAT voltage is developed across the drain-source resistance $r_{on}$ of MN1 resulting in a CTAT bias current:

$$Ibias = \frac{V_{be}}{r_{on}} \tag{7}$$

Figure 8:
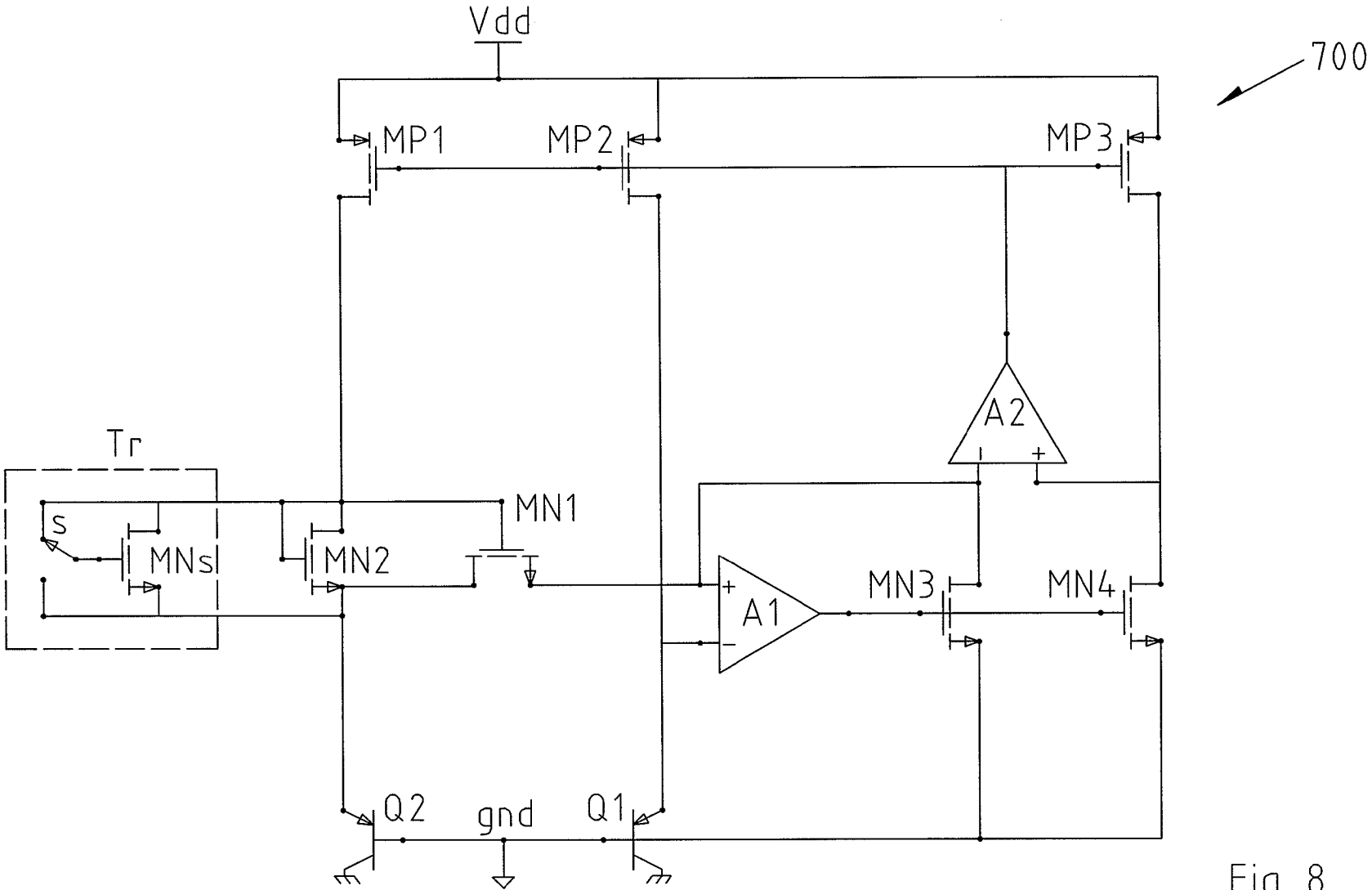
FIG. 8 is a schematic circuit diagram of a circuit provided in accordance with the teaching of the present invention.

Referring now to FIG. 8, there is illustrated another bias current generator 700 which generates a PTAT bias current without using a resistor in accordance with the teaching of the present invention. The bias current generator 700 includes a first PNP bipolar transistor Q1 operating at a first collector current density and a second PNP bipolar transistor Q2 operating at a second collector current density which is less than that of the first collector current density. The emitter of the first bipolar transistor Q1 is coupled to the inverting input of the first amplifier A1. The emitter of the second bipolar transistor Q2 is coupled to the non-inverting input of a first operational amplifier A1 via a load NMOS transistor MN1 operating in the triode region. The bases and collectors of both bipolar transistors Q1 and Q2 are coupled to ground. The load NMOS transistor MN1 is operably coupled to a biasing device, in this case, a diode configured NMOS transistor MN2 such that MN1 operates in the triode region and MN2 operates in saturation. The gate of MN1 is coupled to the gate and drain of MN2, and the source of MN1 is coupled to the non-inverting input of the amplifier A1. The output of the first amplifier A1 drives the gates of two NMOS transistors MN3 and MN4 of substantially similar aspect ratios (W/L). The transistors MN3 and MN4 form part of a current mirror arrangement.

A trimming circuit Tr is operably coupled to the diode configured NMOS transistor MN2 for varying the resistance $r_{on}$ of the load MOS device MN1. It will be appreciated by those skilled in the art that by varying the resistance of MN1 that the bias current can be tuned to a desired value. The trimming circuit Tr is substantially similar to the trimming circuit of FIG. 5 and FIG. 6 and operates in a similar manner.

A second amplifier A2 which has an inverting input, non-inverting input and an output drives three PMOS transistors, namely, MP1, MP2 and MP3. The three PMOS transistors are also part of the current mirror arrangement. The output of the second amplifier A2 is coupled to the gates of MP1, MP2 and MP3. The drain of MN3 is coupled to the inverting input of the amplifier A2, and the drain of MN4 is coupled to the non-inverting input of the amplifier A2. The sources of both MN3 and MN4 are coupled to ground. The drain of MP1 is coupled to the gate-drain of MN2. The drain of MP2 is coupled to the emitter of Q1. The drain of MP3 is coupled to the drain of MN4. The non-inverting input of amplifier A1 is coupled to the inverting input of the amplifier A2.

As a consequence of the differences in collector current densities between the bipolar transistors Q1 and Q2 a base-emitter voltage difference ($\Delta V_{be}$) is developed across the drain-source resistance $r_{on}$ of MN1 resulting in a PTAT bias current:

$$Ibias = \frac{\Delta V_{be}}{r_{on}} \tag{8}$$

The bias current flows from MN1 to the drain of MN3. The second amplifier A2 forces the voltages at its inverting and non-inverting inputs of A2 to be the same. As MN3 and MN4 have the same aspect ratios and their drain source voltages as well as their gate source voltages are the same, their drain current will also be the same. In other words, the drain current of MN4 will track the drain current of MN3. The drain current of MN4 is mirrored by each of the PMOS transistors MP1, MP2 and MP3. The aspect ratios of MP3 and MP2 are substantially similar, and therefore they provide substantially the same bias current. However, MP1 supplies bias current to the emitter of Q1 as well as the drain of MN1. Therefore, if Q1 and Q2 are to be biased with same amount of current the aspect ratio of MP1 must be greater than the aspect ratio of MP2 to account for some of the current which flows through MN1.

The bias current generator 700 has a high power supply rejection ratio due to the logarithmic relationship of base-emitter voltage of Q1 and Q2 versus their emitter currents. Thus, the bias current $I_{bias}$ is less dependent in variations in the power supply. Furthermore, as the drain current of MN4 tracks the drain current of MN3 even slight variations in the supply voltage is inherently compensated.

It will be understood that what has been described herein are exemplary embodiments of circuits which have many advantages over the bias current generators known heretofore. By providing a transistor operating in the triode region circuits provided in accordance with the teaching of the invention are less sensitive to process variations compared to circuits using resistors. A further advantage is that the generator occupies less silicon area as the MOS devices used within the context of the present invention may be implemented in smaller silicon area than resistors.

While the present invention has been described with reference to exemplary arrangements and circuits it will be understood that it is not intended to limit the teaching of the present invention to such arrangements as modifications can be made without departing from the spirit and scope of the present invention. In this way it will be understood that the invention is to be limited only insofar as is deemed necessary in the light of the appended claims.

It will be understood that the use of the term "coupled" is intended to mean that the two transistor s are configured to be in electric communication with one another. This may be achieved by a direct link between the two transistors or may be via one or more intermediary electrical transistors or other electrical elements.

Similarly the words "comprises" and "comprising" when used in the specification are used in an open-ended sense to specify the presence of stated features, integers, steps or components but do not preclude the presence or addition of one or more additional features, integers, steps, components or groups thereof.

I claim:

1. A bias current generator comprising:

a first amplifier having an inverting input, a non-inverting input and an output;

a first bipolar transistor having a base-emitter voltage associated with a first one of the inverting or non-inverting inputs of the first amplifier;

a load MOS transistor comprising a gate, a source, and a drain, wherein the load MOS transistor is associated with a second one of the inverting or non-inverting inputs of the first amplifier, wherein the gate of the load MOS transistor is operatively coupled to the output of the first amplifier;

a second bipolar transistor operating at a lower collector current density than that of the first bipolar transistor, wherein a base-emitter voltage of the second bipolar transistor is also associated with the second one of the inverting or non-inverting inputs of the first amplifier such that the base-emitter voltage of the second bipolar transistor is arranged in series with a drain-source voltage of the load MOS transistor; and a biasing MOS transistor associated with the load MOS transistor, wherein the gate of the biasing MOS transistor is operatively coupled to the output of the first amplifier such that a gate to source voltage of the load MOS transistor and a gate to source voltage of the biasing MOS transistor are the same;

wherein the first amplifier, the first bipolar transistor, the second bipolar transistor, the load MOS transistor, and the biasing MOS transistor are arranged in a feedback loop such that the biasing MOS transistor is biased to operate in the saturation region and the load MOS transistor is biased to operate in the triode region;

wherein the first and second bipolar transistors are arranged relative to the load MOS transistor such that operation of the feedback loop develops a voltage across the drain-source resistance $r_{on}$ of the load MOS transistor equivalent to the base-emitter voltage difference $\Delta V_{be}$ between the first bipolar transistor and the second bipolar transistor thereby generating a PTAT bias current.

2. A bias current generator as claimed in claim 1, wherein the bias current generator further comprises a current mirror arrangement driven by the first amplifier for mirroring the generated bias current.

3. A bias current generator as claimed in claim 2, wherein the current mirror arrangement comprises a plurality of PMOS devices.

4. A bias current generator as claimed in claim 1, wherein the load MOS transistor and the biasing MOS transistor have different aspect ratios.

5. A bias current generator as claimed in claim 4, wherein the aspect ratio of the load MOS transistor is greater than the aspect ratio of the biasing MOS transistor.

6. A bias current generator comprising:

a first amplifier having an inverting input, a non-inverting input and an output;

a first bipolar transistor having a emitter, a base, and a collector, wherein the base is electrically coupled to a first voltage reference, wherein the collector is electrically coupled to a second voltage reference, and wherein the emitter is electrically coupled to the inverting input of the first amplifier;

a second bipolar transistor having an emitter, a base, and a collector, wherein the collector is electrically coupled to the second voltage reference, and wherein the emitter is electrically coupled to the non-inverting input of the amplifier;

a load MOS transistor having a gate, a source, and a drain, wherein the gate is electrically coupled to the output of the first amplifier, wherein the source is electrically coupled to the first voltage reference, and wherein the drain is electrically coupled to the base of the second bipolar transistor;

a biasing MOS transistor having a gate, a source, and a drain, wherein the gate is electrically coupled to the output of the first amplifier, and wherein the source is electrically coupled to the first voltage reference, and wherein the drain is electrically coupled to a first node;

a diode connected MOS transistor having a gate, a source, and a drain, wherein the gate and the drain are electrically coupled to the first node, and wherein the source is electrically coupled to third voltage reference;

a first mirror MOS transistor having a gate, a source, and a drain, wherein the gate is electrically coupled to the first node, wherein the source is electrically coupled to the third voltage reference, and wherein the drain is electrically coupled to the emitter of the first bipolar transistor;

a second mirror MOS transistor having a gate, a source, and a drain, wherein the gate is electrically coupled to the first node, wherein the source is electrically coupled to the third voltage reference, and wherein the drain is electrically coupled to the emitter of the second bipolar transistor; and a third mirror MOS transistor having a gate, a source, and a drain, wherein the gate is electrically coupled to the first node, wherein the source is electrically coupled to the third voltage reference, and wherein the drain is electrically coupled to the base of the second bipolar transistor.

7. The bias current generator of claim 6, wherein the load MOS transistor has an aspect ratio greater than an aspect ratio of the biasing MOS transistor.

8. The bias current generator of claim 6, wherein the second bipolar transistor is configured to operate at a lower collector-current density than that of the first bipolar transistor.

* * * * *